US009281621B2

(12) United States Patent
Tian et al.

(10) Patent No.: US 9,281,621 B2
(45) Date of Patent: Mar. 8, 2016

(54) HDMI INTERFACE HAVING A CABLE AND A CONNECTOR WITH A PLURALITY OF TERMINALS AND WIRING ENDS ARRANGED IN PARALLEL AND IN A ROW

(71) Applicants: Nanlv Tian, Guangdong (CN); Jianyun Tang, Guangdong (CN); Minhua Lu, Guangdong (CN); Shijun Liu, Guangdong (CN); Ming Wang, Guangdong (CN)

(72) Inventors: Nanlv Tian, Guangdong (CN); Jianyun Tang, Guangdong (CN); Minhua Lu, Guangdong (CN); Shijun Liu, Guangdong (CN); Ming Wang, Guangdong (CN)

(73) Assignee: Zhiqiang Wang, Shenzhen, Guangdong (CN)

( * ) Notice: Subject to any disclaimer, the term of this patent is extended or adjusted under 35 U.S.C. 154(b) by 0 days.

(21) Appl. No.: 14/278,696

(22) Filed: May 15, 2014

(65) Prior Publication Data

US 2015/0044906 A1 Feb. 12, 2015

(30) Foreign Application Priority Data

Aug. 7, 2013 (TW) ..... 102128427 U

(51) Int. Cl.

| | |
|---|---|
| ***H01R 13/6463*** | (2011.01) |
| ***H01R 12/70*** | (2011.01) |
| ***H01B 11/02*** | (2006.01) |
| *H01B 7/08* | (2006.01) |
| *H01R 12/79* | (2011.01) |
| *H01R 13/506* | (2006.01) |

(52) U.S. Cl.

CPC ..... *H01R 13/6463* (2013.01); *H01B 11/02* (2013.01); *H01R 23/662* (2013.01); *H01B 7/0876* (2013.01); *H01R 12/79* (2013.01); *H01R 13/506* (2013.01)

(58) Field of Classification Search

CPC ..... H01R 23/662; H01R 9/07; H01R 13/658
USPC ..... 439/497, 625–626; 174/113 R, 130
See application file for complete search history.

(56) References Cited

U.S. PATENT DOCUMENTS

| | | | | |
|---|---|---|---|---|
| 5,556,300 | A * | 9/1996 | Parker | 439/497 |
| 7,252,548 | B2 * | 8/2007 | Huang | 439/607.01 |
| 7,892,021 | B2 * | 2/2011 | Clem | 439/497 |
| 8,516,696 | B2 * | 8/2013 | Chawgo | 29/863 |
| 8,546,690 | B2 * | 10/2013 | Masakazu et al. | 174/103 |
| 2007/0054540 | A1 * | 3/2007 | Takeda | 439/404 |
| 2009/0197459 | A1 * | 8/2009 | Yu et al. | 439/497 |
| 2011/0281464 | A1 * | 11/2011 | Hou | 439/607.55 |
| 2011/0281465 | A1 * | 11/2011 | Hou | 439/607.55 |
| 2013/0130546 | A1 * | 5/2013 | Wu et al. | 439/604 |
| 2013/0217253 | A1 * | 8/2013 | Golko et al. | 439/345 |
| 2015/0044911 | A1 * | 2/2015 | Wu et al. | 439/620.22 |

* cited by examiner

*Primary Examiner* — Chandrika Prasad

(57) ABSTRACT

An HDMI cable, an HDMI connector and an HDMI interface for a high-definition video/audio apparatus are provided. The HDMI interface includes the HDMI connector and the HDMI cable. The HDMI connector includes a connecting terminal having an extending cable terminal arranged in parallel in a main body. The HDMI cable includes at least one connecting unit consisting of a plurality of parallel metal wires. An insulating unit covers an outside of a face of the connecting unit, in such a manner that the metal wires are parallel and isolated from each other. The present invention is using design of single row of the connector terminal and single row of the HDMI cable, to simplify an HDMI interface structure and reduce size and weight, and manual identification is not required for pin bit definitions, which simplifies production process, reduces the manual work, and greatly improves production efficiency.

13 Claims, 2 Drawing Sheets

HDMI INTERFACE HAVING A CABLE AND A CONNECTOR WITH A PLURALITY OF TERMINALS AND WIRING ENDS ARRANGED IN PARALLEL AND IN A ROW

CROSS REFERENCE OF RELATED APPLICATION

This present invention claims priority under 35 U.S.C. 119(a-d) to TW 102128427, filed Aug. 7, 2013.

BACKGROUND OF THE PRESENT INVENTION

1. Field of Invention

This invention relates to an HDMI cable, an HDMI connector and an HDMI interface, especially to an HDMI cable, an HDMI connector and an HDMI interface for high definition multimedia interface.

2. Description of Related Arts

HDMI means high definition multimedia interface. An HDMI interface can provide a data transmission bandwidth up to 5 Gbps to transmit uncompressed audio signals and high resolution video signals. Furthermore, it ensures audio and/or video signal transfer of highest quality without digital-analog or analog-digital conversion before the transfer. HDMI is a digital video/audio interface technology widely used in high definition video/audio transmission. An HDMI cable and an HDMI connector together compose an HDMI interface. Therefore, to put it a simple way, only one HDMI cable is required to transfer audio and video signals at the same time, while more than one cable is needed to get connected for conventional technology. Moreover, wireless conversion between digital and analog signals improves audio and video transmission quality. For consumers, the HDMI technology provides vivid picture quality, and further greatly simplifies installation of home theater system as the same one cable is used for both audio and video signals.

The conventional HDMI interface consists of two parts: an HDMI connector, and an HDMI cable. Such an HDMI connector has a structure as described in an application CN201010251398.8, comprising an insulation body, a first row of terminals, a second row of terminals and a shielding shell, wherein the front end face of the insulation body extends forward to form a tongue plate, and an upper terminal groove and a lower terminal groove are correspondingly arranged on the upper surface and the lower surface of the tongue plate; the first row of terminals is arranged on the insulation body, plug parts of the first row of terminals are embedded into the lower terminal groove, soldering parts of the first row of terminals are bent to form two groups which respectively laterally extend out of the left side surface and the right side surface of the insulation body; the second row of terminals is arranged on the insulation body, plug parts of the second row of terminals are embedded into the upper terminal groove, and soldering parts of the second row of terminals extend backwards out of the rear end face of the insulation body; and the shielding shell covers outside the insulation body and the tongue plate. It can be seen that the conventional HDMI connector is configured in a structure with two rows of terminals so that the HDMI cables can be evenly arrayed to get welded. It not only makes the connector thicker and more massive, but also requires filling two rows of pins with solder paste for the upper and lower HDMI cables and dividing the core wire into two, upper and lower, rows for welding. Owing to the existence of uncontrollable factors, relatively high rejection rate, and liability to false welding and short circuit, manufacturing costs are increased and productive efficiency is reduced.

The conventional HDMI cable is of a structure constituted by a plurality of round twisted cables, such as an HDMI cable according to an application CN201020684119.2 which comprises at least one core wire, at least one outer twisted pair core wire and a core wire coating. An inner layer aluminum foil mylar, inner twisted pair core wires, an internal effusion ground wire and an anti-electromagnetic interference ground wire are arranged inside the corer wire; the core wire is coated by an outer layer aluminum foil mylar, an anti-electromagnetic interference braid core wire and the core wire coating; the inner twisted pair core wires and the outer twisted pair core wires are in respectively round laminated structures and comprise conductor layers and insulating layers arranged outside the conductor layers; the conductor layers are made of tin-plated copper cores with the specification of 36AWG; and the outer diameter of the core wire is 3.6±0.15 mm. However, such a structure brings a lot of difficulties in processing, as it is imaginable how hard it is to process multiple twisted wires in a cable with an extremely small diameter, and meanwhile the processing costs is rather high. In addition, since these HDMI cables employ a twisted structure, a numerous series of operations are demanded in its processing before welding, including uncoating, aluminum foil stripping, sleeve penetrating, hot air blowing, wire splitting, wire core cutting and core wire stripping, and the step of wire splitting requires filling two, upper and lower, rows of pins with solder paste and dividing the core wire into two, upper and lower, rows for welding, where the definition of pin position is identified manually and twisted wires are split with respect to pin positions. As a result, the conventional HDMI is hard to process, which increases the procedures and production costs.

SUMMARY OF THE PRESENT INVENTION

In view of the above, this invention has a primary object to provide an HDMI cable, an HDMI connector and an HDMI interface for high definition video/audio playback devices, wherein the HDMI interface uses a connector with a single row of terminals and an HDMI cable adopting a single row design so as to simplify a structure of the HDMI interface, reduce volume and weight thereof, and lower production costs. Moreover, there is no need to manually identify definition of pin position, which will facilitate a production process, lessen manual work, and substantially improve production efficiency.

The second object of this invention is to disclose an HDMI cable, an HDMI connector and an HDMI interface for high definition video/audio playback devices, wherein wire splitting is not required before welding the HDMI cable, which will effectively cut down production procedures and make the HDMI cable of the present invention thinner and much lighter.

Another object of the present invention is to provide an HDMI cable, an HDMI connector and an HDMI interface for high definition video/audio playback devices, wherein the HDMI interface has good shielding effect as well as a precise and stable range of characteristic impedance control to ensure stability of signal transmission.

To achieve the above objects, the present invention is carried out by way of the following technical solutions.

An HDMI interface for high definition video/audio playback devices comprises an HDMI connector and an HDMI cable, the HDMI connector comprising a housing, a body and a plurality of connecting terminals, wherein each connecting terminal has an extending wiring end, and the wiring ends are arranged in parallel and provided within the body in a row.

The HDMI cable comprises: a connecting unit, consisting of a plurality of twisted metal wires in parallel, for connection with an HDMI connector; and an insulating unit covering an outer surface of a main body of the connecting unit and arranging the twisted metal wires separated from each other in parallel.

The HDMI connector further comprises a protection gland covering over the wiring ends of the connecting terminals for sealing and containing the connecting terminals.

Further, the protection gland is provided with a plurality of grooves on an inner surface thereof, a number of the grooves equals to a number of the connecting terminals, so that the HDMI cable is electrically connected with the connecting terminals via the protection gland.

Further, the protection gland has clamping buckles on two sides thereof, clamping slots corresponding to the clamping buckles are provided on the housing or the body, and the clamping buckles is able to be clamped to the clamping slots to enhance tightness and stability of the protection gland.

Further, the protection gland has a boss on the inner surface thereof, on which the grooves are provided, so that the grooves is able to be closely engaged with the wiring ends of the connecting terminals for better tightness and avoiding plastic's harmful effect on the connecting terminals during injection molding.

The HDMI connector further comprises an outer cover that covers an outside of the body and locks with the housing to further protect the HDMI connector from external damage.

Further, the housing and the outer cover are both made of metallic material with sufficient strength to reinforce protection.

Further, the HDMI cable further comprises a shielding unit, the shielding unit and the insulating unit respectively covers outer surfaces of the connecting unit, with the shielding unit covering the connecting unit from one of a parallel upper and a lower outer surfaces of the connecting unit and the insulating unit covering the connecting unit from the other outer surface.

The twisted metal wires of the connecting unit are of any one kind selected from a group consisting of cylindrical, seven-stranded and flat twisted metal wires.

Further, the cylindrical twisted metal wires number is 19+1 or 29+1, of which the 19 or 29 are conventional functional cables and the 1 is a grounding terminal. Said HDMI cable adds a grounding terminal to the conventional HDMI cable to prevent signal attenuation.

The connecting unit has a connecting end provided with no insulating unit for electrical connection with the HDMI connector.

Further, a conducting wire column is provided at an exterior margin of the connecting end of the connecting unit, which is transversely connected with the twisted metal wires to make splitting and separation of the twisted metal wire easier. All users have to do before welding is to cut off the conducting wire column.

The insulating unit is made of PET material so as to be halogen-free and meet the need of environmental protection.

The shielding unit uses characteristic impedance control material specifically made of aluminum foil polyester tape, for the purpose of characteristic impedance control.

The HDMI interface has a woven mesh, which is made of plastic, provided at the joint between the HDMI cable and the HDMI connector to protect the HDMI cable.

The present invention designs the HDMI connector with a single row of welded connecting terminals. A one-step welding molding is able to be implemented to produce the HDMI interface because only one row of pins needs to be filled with solder paste and there is no need to divide the core wire into two, upper and lower, rows. Thereby the connection process gets easier, and is able to effectively cut down production procedures and substantially improve production efficiency. The HDMI cable adopts a parallel structure where multiple twisted metal wires are arranged in parallel and fitted between the insulating units. Just a one-step attachment molding is required before the welding process, and manual identification of pin position definition is no longer necessary, which greatly facilitates the production process, lessens the manual work, and substantially improves the production efficiency.

Besides, the HDMI connector according to the present invention is provided with a single row of terminals, which simplifies the structure of the connector, reduces the volume and weight thereof, and lowers the production costs. The HDMI cable employs a structure with parallel wires, and is attached on the surface thereof with an extra layer of the special characteristic impedance control material to shield electromagnetic interference and control characteristic impedance. It has good shielding effect as well as a precise and stable range of the characteristic impedance control up to 100±10Ω so as to ensure the stability of the signal transmission.

These and other objectives, features, and advantages of the present invention will become apparent from the following detailed description, the accompanying drawings, and the appended claims.

DETAILED DESCRIPTION OF THE PREFERRED EMBODIMENT

To explain the objects, technical solutions and advantages of the present invention in a clearer way, here is a detailed description with reference to the drawings and embodiments. It is to be understood that any embodiment described herein is intended to be illustrative, without any limitation to the present invention.

Figure 1:
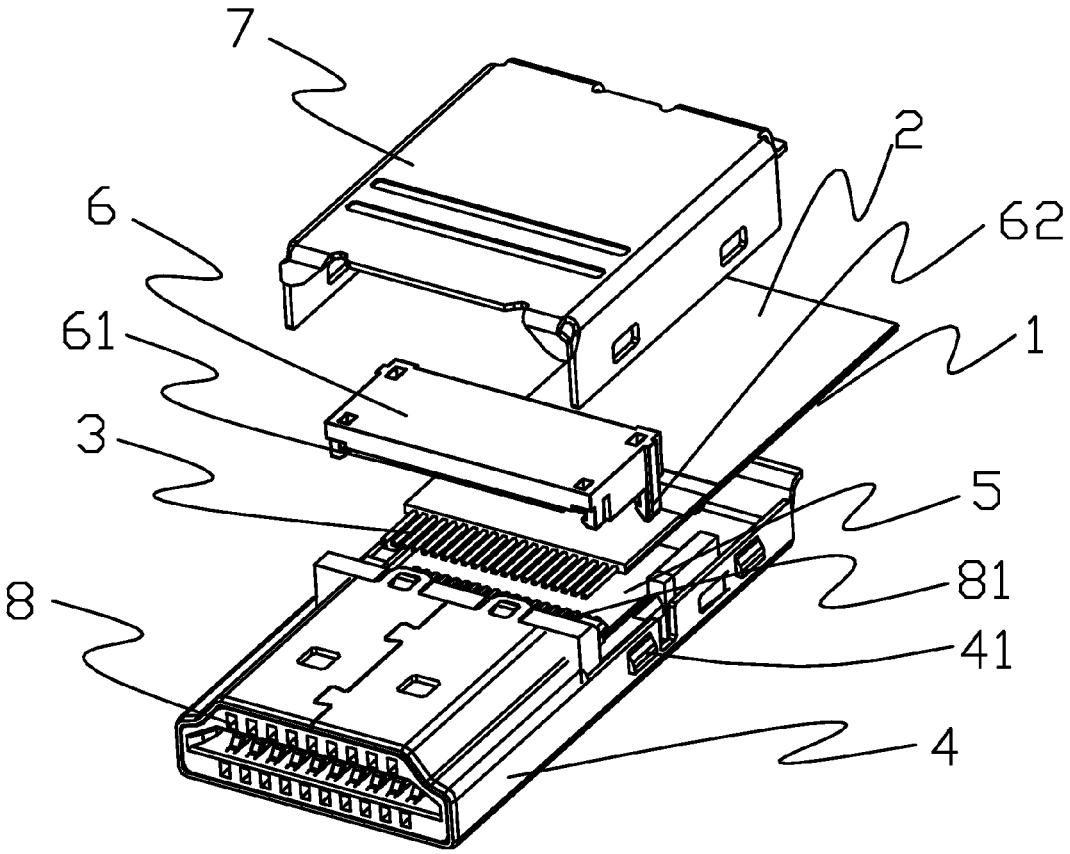
FIG. 1 is a structure diagram of an implementation according to the present invention.

As FIG. 1 shows, an embodiment of the present invention is an HDMI interface for high definition video/audio playback devices, which comprises an HDMI cable and an HDMI connector, wherein the HDMI connector comprises a housing 4, a body 5, a protection gland 6, an outer cover 7 and connecting terminals 8, and the HDMI cable comprises a shielding unit 1, an insulating unit 2 and twisted metal wires 3.

Figure 2:
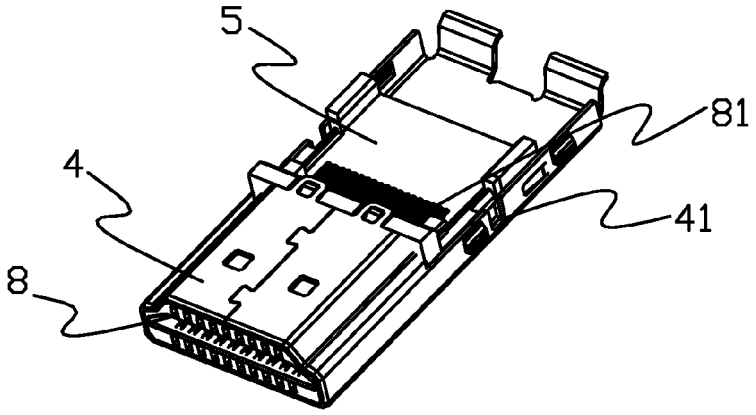
FIG. 2 is a structure diagram of the housing, body and connecting terminals of the HDMI connector according to the present invention.
Figure 3:
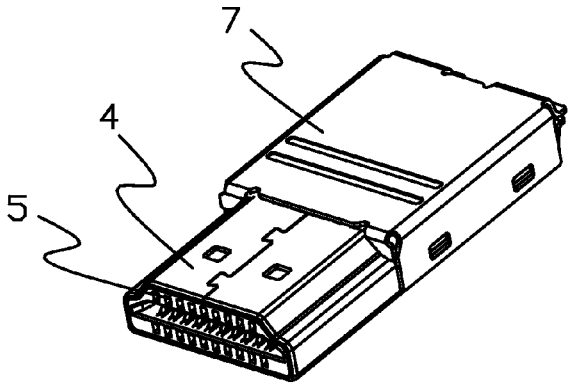
FIG. 3 is a structure diagram of an assembled implementation according to the present invention.

FIG. 1-3 illustrate that a key feature of the HDMI connector is that the connecting terminals 8 have extending wiring ends 81 which are arranged in parallel and provided within the body 5 in a row, the housing 4 covers the body 5, and the body 5 is provided with the connecting terminals 8. It is unnecessary to go into details as the above structure follows the conventional design scheme and has no alteration.

In addition to the design of the connecting terminals 8, the HDMI connector according to the present invention further comprises a protection gland 6 (an existence of the protection gland will save an injection inner membrance and thereby lower production costs), which covers over the wiring ends 81 of the connecting terminals for sealing and containing the connecting terminals 8. To be specific, the protection gland 6 has a boss 61 on an inner surface thereof, on which a plurality of grooves are provided, a number of the grooves equals to a number of the connecting terminals, so that the HDMI cable is electrically connected with the wiring ends 81 of the connecting terminals 8 via the protection gland 6. The structure with said boss 61 helps the HDMI cable to get closely pressed onto the wiring ends 81 of the connecting terminals for better tightness and avoiding plastic's harmful effect on the connecting terminals during injection molding.

Moreover, to firmly cover over the wiring ends 81, the protection gland 6 has clamping buckles 62 on two sides thereof, clamping slots 41 corresponding to the clamping buckles are provided on the housing (or the body), and the clamping buckles 62 is able to be clamped to the clamping slots 41 so as to enhance tightness and stability of the protection gland 6.

With reference to FIG. 3, to maintain tightness of the whole HDMI connector, the HDMI connector further comprises an outer cover 7 covering an outside of the body 5 so that the body 5 is encapsulated between the outer cover 7 and the housing 4, and locks with the housing 4 to further protect the HDMI connector from external damage and in the meantime ensure tightness of the HDMI connector.

Normally the housing 4 and the outer cover 7 are both made of metallic material with sufficient strength to reinforce protection.

Figure 4:
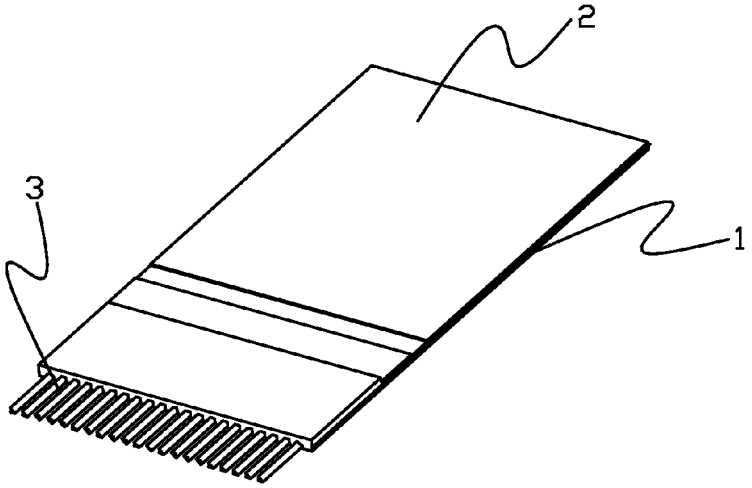
FIG. 4 is a structure diagram of the HDMI cable according to present invention.
Figure 5:
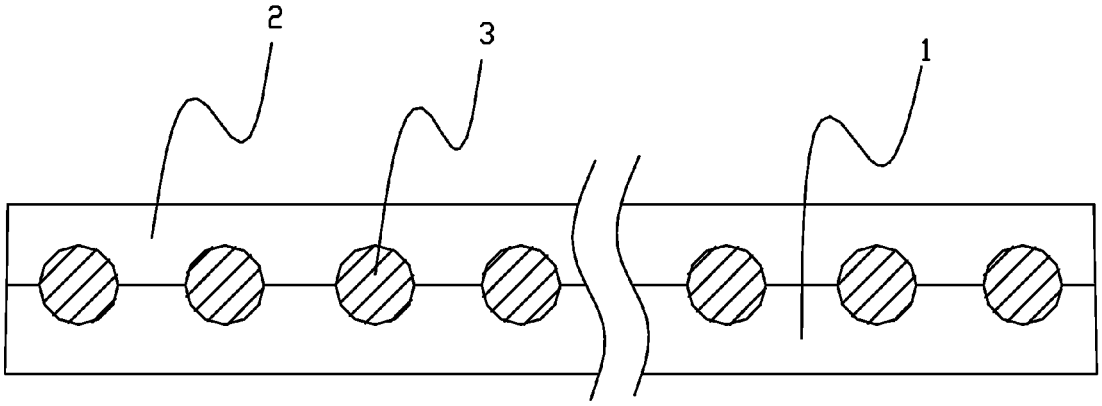
FIG. 5 is a cross-section cutaway view of the HDMI cable as showed in FIG. 1.

FIG. 4~5 are structure diagrams of the HDMI cable according to the present invention, in which the HDMI cable comprises a connecting unit 3, an insulating unit 2 and a shielding unit 1, wherein the connecting unit 3 consists of a plurality of twisted metal wires in parallel for connection with the HDMI connector, and the insulating unit 2 covers the upper outer surface of a main body of the connecting unit and arranges the twisted metal wires separated from each other in parallel. The shielding unit 1 covers the lower outer surfaces of the twisted metal wires, and is able to exchange position with the insulating unit 2.

The twisted metal wires of the connecting unit 3 are normally cylindrical twisted metal wires and preferably cylindrical twisted copper wires (or, either seven-stranded or flat twisted metal wires).

More importantly, said cylindrical twisted copper wires number is 19+1 or 29+1, of which the 19 or 29 perform conventional functions and the 1 is a grounding terminal to prevent signal attenuation.

Said connecting unit has a connecting end 31 exposed to air and provided with no insulating unit or shielding unit for electrical connection with the HDMI connector.

The insulating unit 2 is made of PET material so as to be halogen-free and meet the need of environmental protection.

The shielding unit 1 uses characteristic impedance control material made of aluminum foil polyester tape for a purpose of characteristic impedance control, so as to enhance anti-interference performance of the HDMI cable.

Usually, a woven mesh is provided at a joint between the HDMI cable and the HDMI connector, which is sleeved on the outside of the HDMI cable and pressed and fixed by the HDMI connector, to protect the HDMI cable.

As experiments have verified, the HDMI cable made according to the present invention is characterized by:

1. A long flex life: no short or open circuit after swinging over 5,000 times.

2. Controllable characteristic impedance: the HDMI cable implemented according to the present invention employs the structure with parallel wires and is attached on the surface thereof with an extra layer of the special characteristic impedance control material, so as to control the characteristic impedance in a precise and stable range up to 100±10Ω to further ensure the stability of signal transmission.

3. Low manufacturing costs: reduction of production processes and raw material, together with high yield rate, contribute to lower costs.

4. High productive efficiency: production process gets facilitated tremendously, manual work gets lessened, and consequently production efficiency gets improved substantially.

5. Advantages in structure and appearance: the flat structure makes the HDMI cable lighter, thinner, smaller and more artistic.

6. Easier connection: the HDMI connector is designed with a single row of the welded connecting terminals, and therefore a one-step welding molding is able to be implemented to produce the HDMI interface, because only a single row of pins needs to be filled with solder paste and there is no need to divide the core wire into two, upper and lower, rows.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An HDMI (High Definition Multimedia Interface) interface for high definition video/audio playback devices, comprising an HDMI cable and an HDMI connector;

wherein the HDMI cable comprises:

a connecting unit, consisting of a plurality of twisted metal wires in parallel, for connection with the HDMI connector; and an insulating unit covering an outer surface of the connecting unit and arranging the twisted metal wires separated from each other in parallel;

wherein the HDMI connector comprises:

a housing, a body and a plurality of connecting terminals, wherein each of the connecting terminals has an extending wiring end, and the wiring ends are arranged in parallel and provided within the body in a row, in such a manner that all the wiring ends are one-step welded; wherein the HDMI connector further comprises a protection gland covering over the wiring ends of the connecting terminals for sealing and containing the connecting terminals; wherein the protection gland is provided with a plurality of grooves on an inner surface thereof, a number of the grooves equals to a number of the connecting terminals; wherein the protection gland has clamping buckles on two sides thereof, clamping slots corresponding to the clamping buckles are provided on the housing or the body, and the clamping buckles is able to be clamped to the clamping slots to enhance tightness and stability of the protection gland.

2. The HDMI interface for high definition video/audio playback devices according to claim 1, wherein the HDMI cable further comprises a shielding unit, the shielding unit and the insulating unit respectively covers outer surfaces of the connecting unit with the shielding unit covering the connecting unit from one of a parallel upper and a lower outer surfaces of the connecting unit and the insulating unit covering the connecting unit from the other outer surface.

3. The HDMI interface for high definition video/audio playback devices according to claim 1, wherein the insulating unit is made of PET material so as to be halogen-free and meet the need of environmental protection.

4. The HDMI interface for high definition video/audio playback devices according to claim 1, wherein the shielding unit uses characteristic impedance control material made of aluminum foil polyester tape, so as to enhance anti-interference performance of the HDMI cable.

5. The HDMI interface for high definition video/audio playback devices according to claim 1, wherein the twisted metal wires of the connecting unit are cylindrical twisted metal wires.

6. The HDMI interface for high definition video/audio playback devices according to claim 1, wherein the twisted metal wires of the connecting unit are seven-stranded wires.

7. The HDMI interface for high definition video/audio playback devices according to claim 1, wherein the twisted metal wires of the connecting unit are flat twisted metal wires.

8. The HDMI interface for high definition video/audio playback devices according to claim 5, wherein a cylindrical twisted metal wires number is 19+1 or 29+1, of which the 19 or 29 are conventional functional cables and the 1 is a grounding terminal.

9. The HDMI interface for high definition video/audio playback devices according to claim 1, wherein the connecting unit has a connecting end provided with no insulating unit for electrical connection with the HDMI connector.

10. The HDMI interface for high definition video/audio playback devices according to claim 1, wherein the protection gland has a boss on the inner surface thereof, on which the grooves are provided.

11. The HDMI interface for high definition video/audio playback devices according to claim 1, wherein the HDIM connector further comprises an outer cover covering an outside of the body and locking with the housing.

12. The HDMI interface for high definition video/audio playback devices according to claim 1, wherein the housing and the outer cover are both made of metallic material with sufficient strength to reinforce protection.

13. The HDMI interface for high definition video/audio playback devices according to claim 1, wherein the HDMI interface has a woven mesh provided at a joint between the HDMI cable and the HDMI connector, which is sleeved on an outside of the HDMI cable and pressed and fixed by the HDMI connector.

* * * * *